US010995408B2

(12) United States Patent
Yang

(10) Patent No.: US 10,995,408 B2
(45) Date of Patent: May 4, 2021

(54) METHOD OF ELECTROLESS NICKLE PLATING ON SURFACE OF SILICON CARBIDE POWDER

(71) Applicant: Tangshan Normal University, Hebei (CN)

(72) Inventor: Huijing Yang, Hebei (CN)

(73) Assignee: Tangshan Normal University, Tangshan (CN)

( * ) Notice: Subject to any disclaimer, the term of this patent is extended or adjusted under 35 U.S.C. 154(b) by 96 days.

(21) Appl. No.: 16/207,022

(22) Filed: Nov. 30, 2018

(65) Prior Publication Data

US 2019/0264330 A1 Aug. 29, 2019

(30) Foreign Application Priority Data

Feb. 24, 2018 (CN) ..... 201711383356.8

(51) Int. Cl.
*C23C 18/36* (2006.01)
*C23C 18/16* (2006.01)
*C23C 18/18* (2006.01)

(52) U.S. Cl.
CPC ..... *C23C 18/36* (2013.01); *C23C 18/1642* (2013.01); *C23C 18/1658* (2013.01); *C23C 18/1666* (2013.01); *C23C 18/1893* (2013.01)

(58) Field of Classification Search
CPC ... C23C 18/16; C23C 18/18; C23C 18/20–54; C23C 18/36; C23C 18/1642; C23C 18/1893; C23C 18/1666; C23C 18/1658; C23C 18/1635
See application file for complete search history.

(56) References Cited

U.S. PATENT DOCUMENTS 3,616,296 A * 10/1971 Bernhardt ..... C23C 18/285 205/167
4,061,802 A * 12/1977 Costello ..... C23C 18/36 427/304
2005/0227073 A1* 10/2005 Oyamada ..... B22F 1/025 428/403
2016/0083859 A1* 3/2016 Cao ..... C25D 3/12 205/169

FOREIGN PATENT DOCUMENTS

CN 1730440 A * 2/2006
CN 103451634 A * 12/2013
CN 106756903 A * 5/2017 ..... C23C 18/1639
WO WO-2018033577 A1 * 2/2018 ..... B22F 1/025

* cited by examiner

*Primary Examiner* — Dah-Wei D. Yuan
*Assistant Examiner* — Nga Leung V Law

(57) ABSTRACT

A method of electroless nickel plating on surface of silicon carbide powder with a uniform and stable coating. In this method, ultrasonic assist is introduced in the pre-treatment and during plating process, and the powder particles in the liquid are dispersed and deagglomerated by the mechanical action and cavitation of the ultrasonic waves, thereby achieving a uniform dispersion of the powder in the dispersant. Furthermore, a reducing agent is slowly added during plating so as to give a more uniform and stable deposition of the coating onto the surface of the powder particles, and thus a silicon carbide core-nickel shell structure with an excellent powder dispersibility and a uniform and stable coating is produced.

10 Claims, 13 Drawing Sheets

METHOD OF ELECTROLESS NICKLE PLATING ON SURFACE OF SILICON CARBIDE POWDER

CROSS-REFERENCE TO RELATED APPLICATIONS

This application claims the benefit of priority from Chinese Application No. 201711383356.8, filed on Feb. 24, 2018. The content of the aforementioned application, including any intervening amendments thereto, is incorporated herein by reference.

TECHNICAL FIELD

The present application relates to nickel plating on powder surface, and more specifically to a method of electroless nickel plating on surface of silicon carbide powder with a uniform and stable coating.

BACKGROUND

Electroless plating is a reaction that reduces metal ions to metal under the reducing agent and subsequently deposits a metallic layer on a plating member having a catalytic surface. Electroless plating does not require electrical power and is easy to perform. The coating is uniform and excellent with a low void ratio, high adhesion, corrosion resistance and wear resistance and an excellent functionality. Moreover, electroless plating can be used for deposition on various non-metallic substrates.

However, for the electroless plating process of powder, mechanical stirring is generally used to disperse powder in the solvent in the conventional pretreatment and the plating process due to the characteristics of powder like small particle size, large surface area and high surface activity. Nevertheless, the limited dispersion of mechanical stirring may result in a poor dispersion effect of powder in the solvent especially for the micro and nano powder particles, which may cause agglomeration and non-uniform dispersion of the powder in the solvent, thereby leading to an uncontrollable plating rate and a non-uniform coating.

Therefore, there is a need for those skilled in the art to develop a simple and controllable method for electroless nickel plating on the surface of silicon carbide powder with a uniform and stable coating.

SUMMARY

The application provides a method for electroless nickel plating on a surface of silicon carbide powder with a uniform and stable coating. Ultrasonic assist is introduced in the pre-treatment and the plating process to make powder particles disperse and deagglomerate in the liquid with the mechanical action and cavitation of ultrasonication, producing a uniform dispersion of the powder in the dispersant. Furthermore, a reducing agent is slowly added during the plating so as to produce a more uniform and stable deposition on the surface of the powder particles. Thus, a silicon carbide core-nickel shell structure material with a good dispersion of powder and a uniform and stable coating is obtained at the same time.

A method of electroless nickel plating on surface of silicon carbide powder with a uniform and stable coating includes:

(1) burning the silicon carbide powder at high temperature to oxidize the silicon carbide powder;

(2) placing the oxidized silicon carbide powder in a hydrophilizing solution to obtain a suspension; subjecting the suspension to stirring, ultrasonication and vacuum filtration to obtain a filter residue; and washing the filter residue to neutral to produce a hydrophilized silicon carbide powder; wherein the hydrophilizing solution is prepared by dissolving hydrofluoric acid in a hydrochloric acid solution;

(3) placing the hydrophilized silicon carbide powder in a sensitizing solution to obtain a suspension; subjecting the suspension to stirring, ultrasonication and vacuum filtration to obtain a filter residue; and washing the filter residue to neutral to produce a sensitized silicon carbide powder; wherein the sensitizing solution is prepared by dissolving stannous chloride in a hydrochloric acid solution;

(4) placing the sensitized silicon carbide powder in an activating solution to obtain a suspension; subjecting the suspension to stirring, ultrasonication, and vacuum filtration to obtain a filter residue; and washing the filter residue to neutral to obtain an activated silicon carbide powder; wherein the activating solution is prepared by dissolving palladium chloride in a hydrochloric acid solution; and (5) mixing nickel sulfate, trisodium citrate and ammonium chloride at a weight ratio of 1:4-5:0.2-0.3 to obtain a mixture; dissolving the mixture with water to obtain a plating solution with pH adjusted to 8.5-9.5 by ammonia water; and preparing a sodium hypophosphite solution as a reducing agent for use;

placing the activated silicon carbide powder in the plating solution to obtain a mixture; transferring the mixture to a water bath under simultaneous ultrasonication and stirring for a dispersion; and dripping the reducing agent into the mixture under continuous mechanical stirring and intermittent ultrasonication to perform a reaction upon temperature of the plating solution rising to 45-50° C.; and subjecting the product to vacuum filtration; and washing, drying and grinding the product to obtain a nickel-plated micronized silicon carbide powder.

In step (1), the burning could not only remove impurities from the raw materials, but also forms a very thin and dense silica film with a strong adhesion to the surface of the silicon carbide powder, which lays a foundation for the stability of the plating and prepares for enhancing the powder hydrophilicity.

In step (2), hydrophilicity of the silicon carbide powder may directly affect the surface modification of the powder since the modification process is carried out in an aqueous solution. This process refers to a hydrophilic treatment in which the oxidation layer (silica) on the surface of the silicon carbide powder is reacted with hydrofluoric acid as $SiO_2+HF \rightarrow SiF_4+H_2O$. An aqueous solution is distributed on the surface of the silicon carbide powder due to the strong water absorption of the silicon fluoride, thereby improving the interfacial wettability of the aqueous solution to the silicon carbide powder and preparing for sensitization treatment. The introduction of ultrasonication in this process could facilitate a uniform reaction between the surface of the silicon carbide powder and hydrofluoric acid.

An aqueous solution is distributed on the surface of the silicon carbide powder after the hydrophilization treatment, so that stannous ions could be uniformly adhered to the surface of the powder under the ultrasonication during the sensitization in step (3), thereby preparing for forming the nucleation point of a metal.

In step (4), the activation treatment of the silicon carbide powder mainly refers to reacting the stannous ions adhered to the surface with the palladium ions in the activation solution, so that palladium is deposited on the surface of the silicon carbide powder as a nucleation point of the metal. The reduced metal particles in the plating solution can be deposited by the catalytic action of the palladium during the plating, thereby achieving a metal coating on the silicon carbide powder. The introduction of ultrasonication in the activation process can produce a more uniform distribution of the nucleation points so as to avoid a non-uniform thickness of the coating caused by the non-uniform distribution of the nucleation points.

The introduction of ultrasonic dispersion in the plating in step (5) can make the silicon carbide powder distribute uniformly in the plating solution and reduce the agglomeration of the silicon carbide powder, thereby facilitating a uniform deposition of the metal on the powder surface.

An ultrasonic assist is introduced in the pre-treatment process and the plating process, and a reducing agent is dripped in the plating in this application. Therefore, a plated powder with a good dispersibility and a stable coating is achieved. In addition, the coating also has an adjustable thickness and a stable bond with the substrate.

Preferably, the silicon carbide powder in step (1) has a particle size of 600-5000 nm.

Preferably, a burning temperature is 800-1200° C., and a burning time is 1.5-2.5 hours. Preferably, the hydrophilizing solution in step (2) is prepared by concentrated hydrochloric acid, hydrofluoric acid and water at a volume ratio of 1:0.9-1.1:9-11. The stirring and the ultrasonication in step (2) are alternately performed 3 times each, stirring for 10 minutes and ultrasonication for 5 minutes each time.

Preferably, in step (3), concentration of the stannous chloride in the sensitizing solution is 20-30 g/L and a weight (g)-volume (mL) ratio of the stannous chloride to concentrated hydrochloric acid is 1:2-3. The concentrated hydrochloric acid is diluted and then used to prepare a stannous chloride solution with a concentration of 20-30 g/L.

Preferably, in step (4), concentration of the palladium chloride in the activating solution is 0.3-0.7 g/L, and a weight (g)-volume (mL) ratio of the palladium chloride to concentrated hydrochloric acid is 1:40-50. The concentrated hydrochloric acid is diluted and then used to prepare a palladium chloride solution with a concentration of 0.3-0.7 g/L.

The above concentrated hydrochloric acid has a mass percentage of hydrogen chloride of 36%-38%. A mass-volume concentration is obtained through dividing the solute mass by the solution volume.

Preferably, in steps (3) and (4), the stirring and the ultrasonication are alternately performed 5 times each for 2 minutes, and no standing is required in the treatment.

Preferably, the mechanical stirring rate in step (4) is 5-10 rps.

Preferably, in step (5), concentrations of the nickel sulfate, trisodium citrate and ammonium chloride in the plating solution are 0.1 mol/L, 0.15 mol/L and 0.18 mol/L, respectively, and concentration of the sodium hypophosphite solution is 0.5-2.0 mol/L.

Preferably, in step (5), one drop of the reducing agent is added every 2-6 seconds, and the dripping and the ultrasonication are alternately performed, each for 30 seconds. The reducing agent is not added during the ultrasonication.

BRIEF DESCRIPTION OF THE DRAWINGS

In order to more clearly clarify the embodiments of the present invention or the technical solutions in the prior art, the drawings used in the embodiments or the description of the prior art will be briefly described below. Obviously, the drawings in the following description are only embodiments of the present invention, and those skilled in the art can obtain other drawings according to the provided drawings without any creative work.

DETAILED DESCRIPTION OF THE PRESENT INVENTION

Figure 1A:
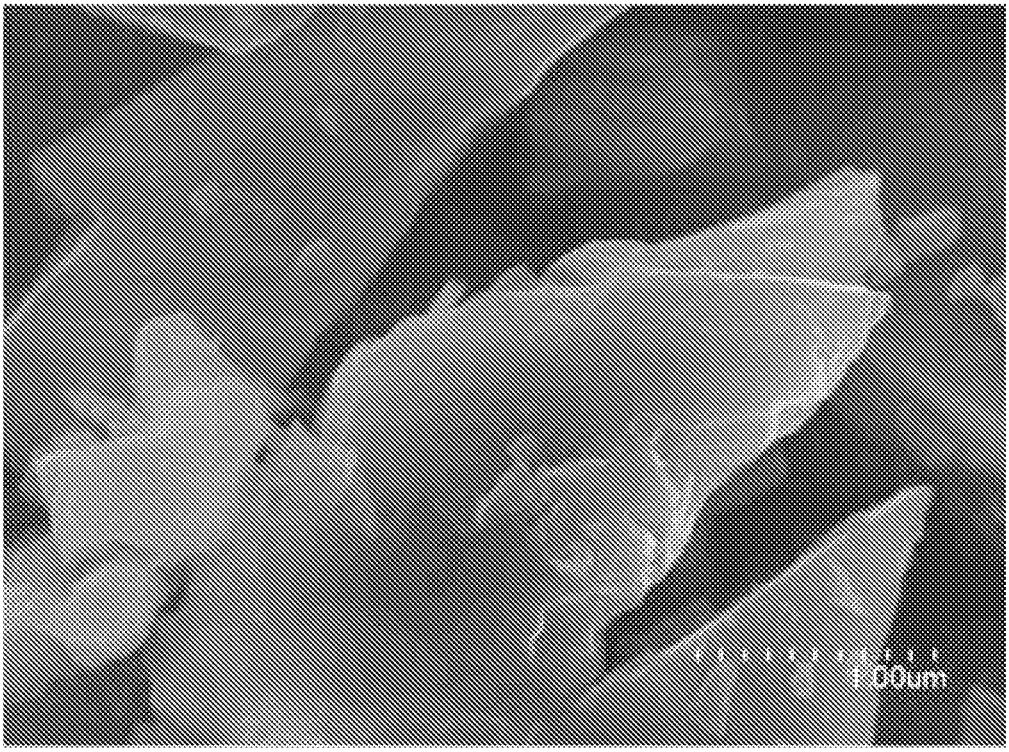
FIGS. 1A-1C show scanning electron microscope (SEM) images with different magnifications of the micronized silicon carbide powder before plating.
Figure 1B:
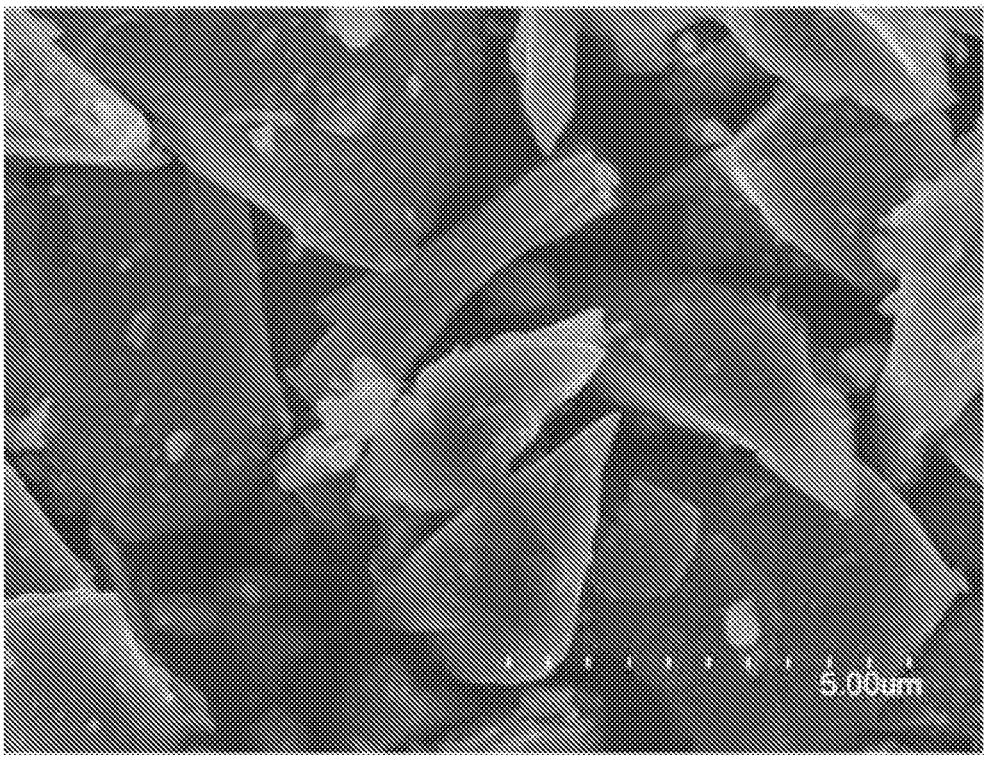
Figure 1C:
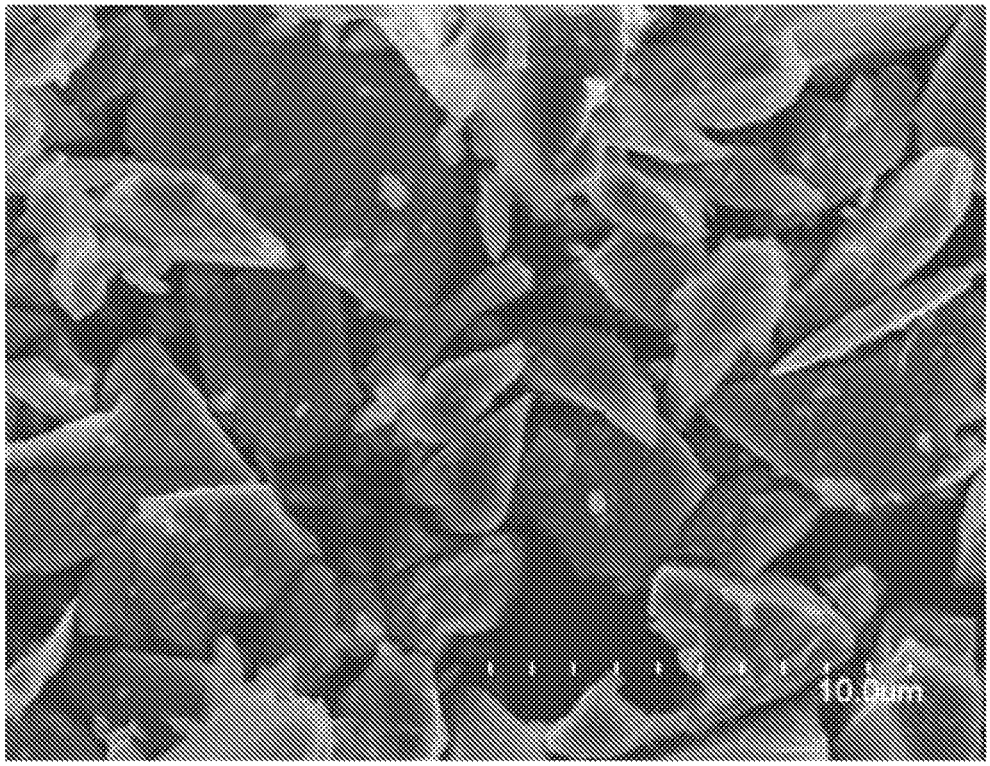

The technical solutions in the embodiments of the present invention are clearly and completely described with reference to the drawings in the embodiments of the present invention. Obviously, the described embodiments are only a part of the embodiments of the present invention. All other embodiments obtained by those skilled in the art based on the embodiments of the present invention and without any creative efforts are within the scope of the present invention.

A method of electroless nickel plating on surface of silicon carbide powder with a uniform and stable plating is disclosed in the embodiments of the present invention.

Example 1

(1) Oxidation

Silicon carbide powder was placed in a high temperature oven and burned at 1000° C. for 2 hours, and then air cooled to room temperature.

(2) Hydrophilization 150 mL of hydrophilizing solution was prepared by mixing 120 mL of deionized water with 15 mL of concentrated hydrochloric acid and 15 mL of hydrofluoric acid. 1 g of the silicon carbide powder after the oxidation treatment was added into the hydrophilizing solution to obtain a suspension. The suspension was magnetically stirred for 10 minutes and then ultrasonicated in an ultrasonic cleaner for 5 minutes. The magnetic stirring and the ultrasonication were repeated 5 times each. Then the suspension was vacuum filtered and the obtained micronized silicon carbide powder was washed to neutral for use.

(3) Sensitization 5 g of stannous chloride dihydrate was dissolved in 200 mL of a hydrochloric acid solution to prepare a stannous chloride solution with a mass-volume concentration of 25 g/L. The hydrochloric acid solution was prepared by diluting 10 mL of concentrated hydrochloric acid 20 times. Deionized water was added to the stannous chloride solution to a volume of 200 mL to produce a sensitizing solution. 1 g of the micronized silicon carbide powder after the hydrophilization treatment was added into the sensitizing solution to obtain a suspension. The suspension was stirred and mixed uniformly and then subjected to alternate magnetic stirring and ultrasonication for 20 minutes, each for 2 minutes. Then the suspension was vacuum filtered and the micronized silicon carbide powder was washed to neutral.

(4) Activation 0.1 g of palladium chloride was dissolved in a hydrochloric acid solution prepared by diluting 5 mL of concentrated hydrochloric acid 40 times to prepare a palladium chloride solution with a concentration of 0.5 g/L. Deionized water was added to the palladium chloride solution to a volume of 200 mL to produce an activating solution. 1 g of the micronized silicon carbide powder after the sensitization treatment was added into the activating solution to obtain a suspension. The suspension was stirred and mixed uniformly and then subjected to alternate magnetic stirring and ultrasonication for 20 minutes, each for 2 minutes. Then the suspension was vacuum filtered and the obtained micronized silicon carbide powder was washed to neutral.

(5) Plating 5.257 g of $NiSO_4.6H_2O$, 8.823 g of $Na_3C_6H_6O_7.2H_2O$ and 1.926 g of $NH_4Cl$ were dissolved separately and mixed to obtain a solution. The solution was adjusted to pH of 9 with ammonia water and was then added with deionized water to a volume of 150 mL to obtain a plating solution. 50 mL of sodium hypophosphite solution (1 mol/L) was prepared as a reducing agent for use.

15 g of the micronized silicon carbide powder after the activation treatment was added into a flask containing the plating solution, and then the flask was transferred to a water bath under simultaneous ultrasonication and stirring for a dispersion. The reducing agent was dropwise added to the flask to start a reaction upon temperature of the plating solution rising to 50° C. and a drop of reducing agent was added every three seconds. The mechanical stirring was simultaneously performed at a rate of 8 rps. The dripping and the ultrasonication were performed alternately, each for 30 seconds.

The reaction was completed when the reaction has been carried out for 100 minutes and no bubbles appeared during ultrasonication. Then the resulting product was vacuum filtered, washed, dried and ground to produce a nickel-plated micronized silicon carbide powder.

Figure 2A:
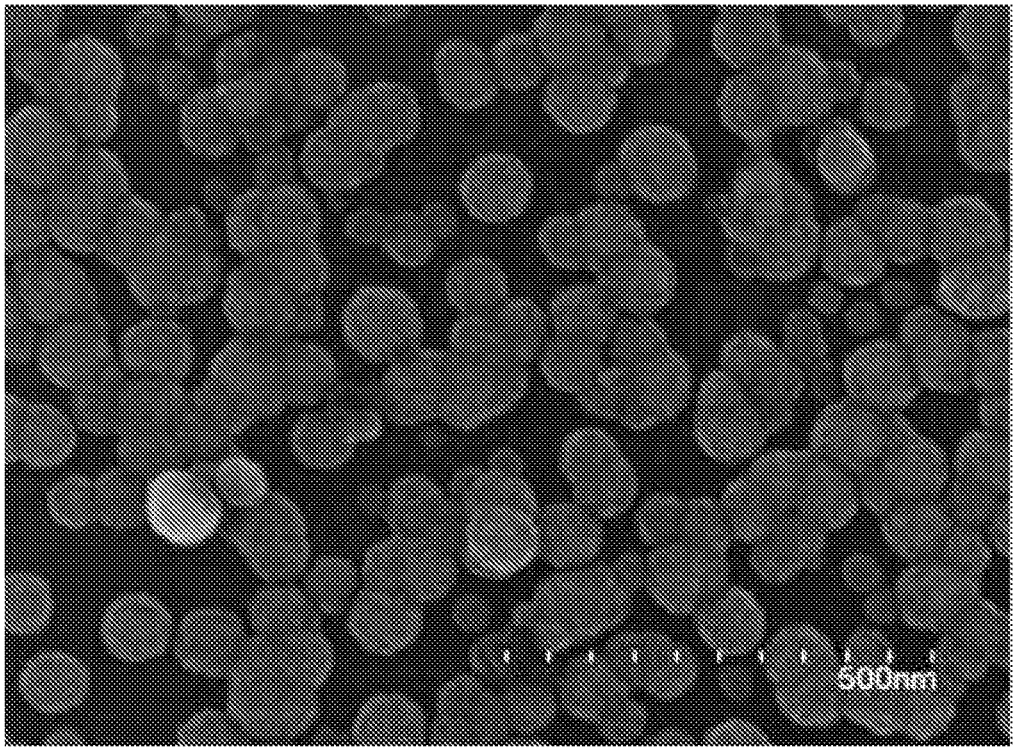
FIGS. 2A-2C show scanning electron microscope (SEM) images with different magnifications of the micronized silicon carbide powder after plating according to a first embodiment.
Figure 2B:
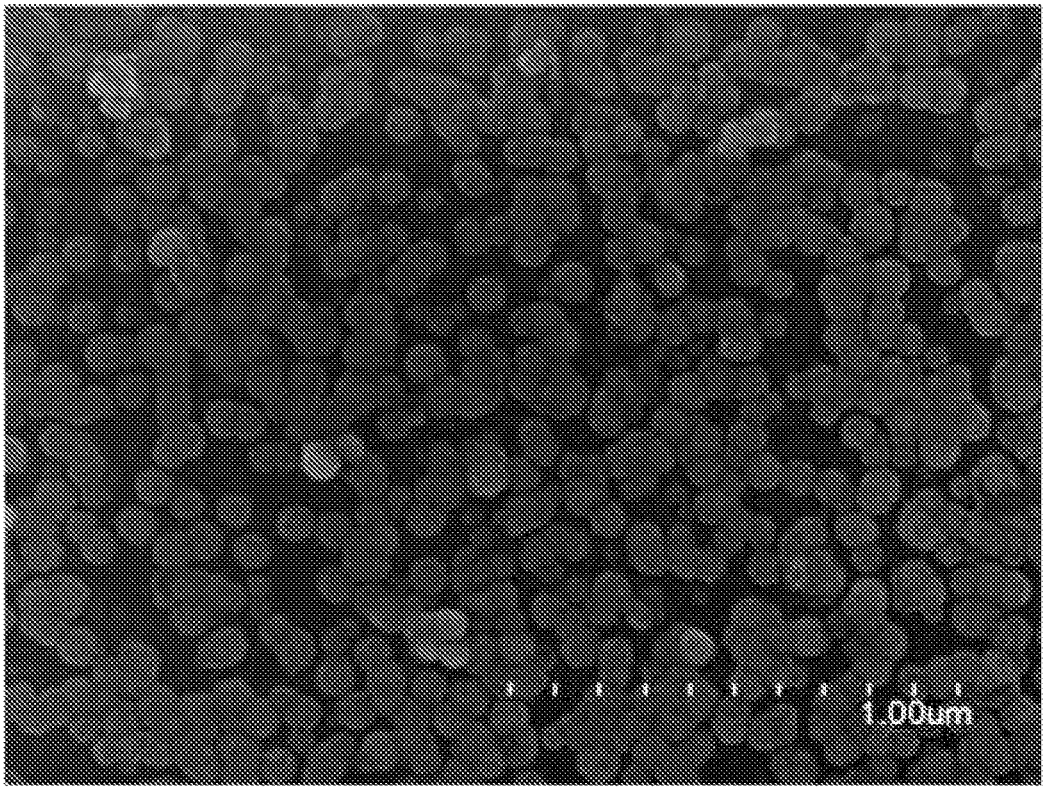
Figure 2C:
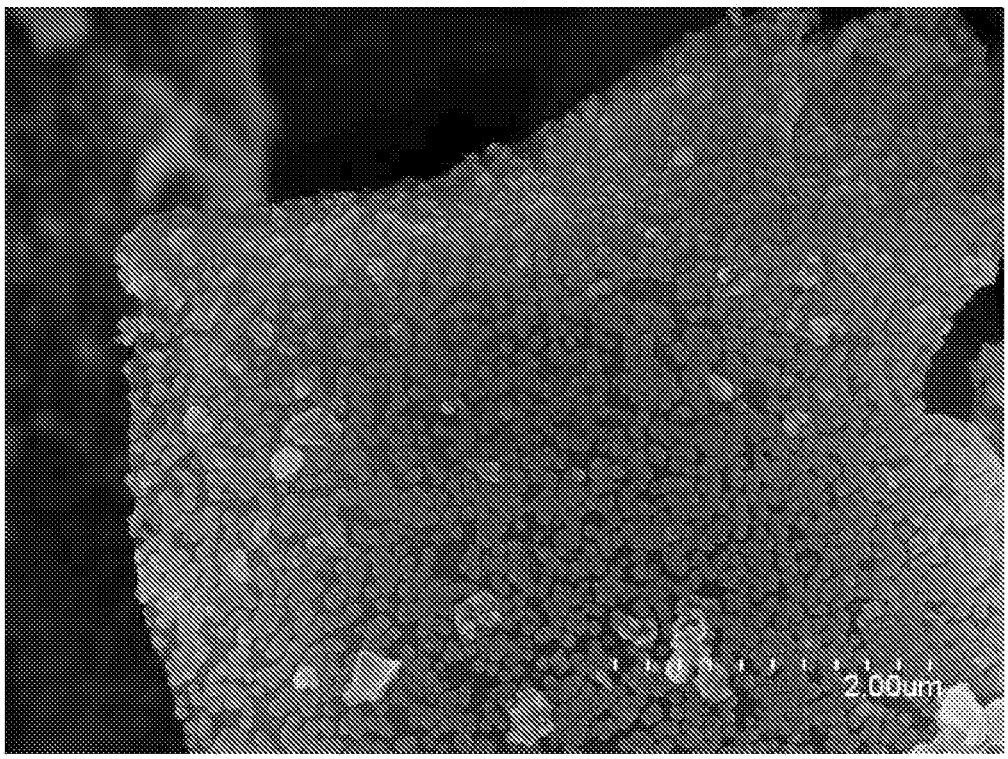

The obtained micronized silicon carbide powder with surface nickel-plated was examined by SEM (scanning electron microscope), and the results revealed that the powder had an excellent dispersibility. The coating surface of the plating is shown in FIGS. 2A-2C.

Example 2

(1) Oxidation

Silicon carbide powder was placed in an oven at high temperature and burned at 800° C. for 1.5 hours, and then air cooled to room temperature.

(2) Hydrophilization 150 mL of hydrophilizing solution was prepared by mixing 120 mL of deionized water, 15 mL of concentrated hydrochloric acid and 15 mL of hydrofluoric acid. 1 g of silicon carbide powder after the oxidation treatment was added into the hydrophilizing solution to obtain a suspension. The suspension was magnetically stirred for 10 minutes and then ultrasonicated in an ultrasonic cleaner for 5 minutes. The magnetic stirring and the ultrasonication were repeated 5 times each. Then the suspension was vacuum filtered and the obtained micronized silicon carbide powder was washed to neutral for use.

(3) Sensitization 5 g of stannous chloride dihydrate was dissolved in 250 mL of a hydrochloric acid solution prepared by diluting 10 mL of concentrated hydrochloric acid 25 times to prepare a stannous chloride solution with a mass-volume concentration of 20 g/L. Deionized water was added to the stannous chloride solution to a volume of 250 mL to produce a sensitizing solution. 1 g of micronized silicon carbide powder after the hydrophilization treatment was added into the sensitizing solution to obtain a suspension. The suspension was stirred and mixed uniformly and then subjected to alternate magnetic stirring and ultrasonic treatment for 20 minutes, each for 2 minutes. Then the suspension was vacuum filtered and the obtained micronized silicon carbide powder was washed to neutral.

(4) Activation 0.1 g of palladium chloride was dissolved in a hydrochloric acid solution prepared by diluting 5 mL of concentrated hydrochloric acid 34 times to prepare a palladium chloride solution with a concentration of 0.3 g/L. Deionized water was added to the palladium chloride solution to a volume of 200 mL to produce an activating solution. 1 g of the micronized silicon carbide powder after the sensitization treatment was added into the activating solution to obtain a suspension. The suspension was stirred and mixed uniformly, and then subjected to alternate magnetic stirring and ultrasonic treatment for 20 minutes, each for 2 minutes. Then the suspension was vacuum filtered and the obtained micronized silicon carbide powder was washed to neutral.

(5) Plating 5.257 g of $NiSO_4.6H_2O$, 8.823 g of $Na_3C_6H_6O_7.2H_2O$ and 1.926 g of $NH_4Cl$ were first dissolved separately and mixed to obtain a solution. The solution was adjusted to pH of 9 with ammonia water and was then added with deionized water to a volume of 150 mL to obtain a plating solution. 50 mL of sodium hypophosphite solution (0.5 mol/L) was prepared as a reducing agent for use.

15 g of the micronized silicon carbide powder after the activation treatment was added into a flask containing the plating solution, and then the flask was transferred to a water bath under simultaneous ultrasonication and stirring for a dispersion. The reducing agent was dropwise added to the flask to start a reaction upon temperature of the plating solution rising to 50° C. and one drop was added every 3 seconds. The mechanical stirring was simultaneously performed at a rate of 5 rps. The dripping and the ultrasonication were performed alternately, each for 30 seconds.

The reaction was completed when performed for 100 minutes and no bubbles appeared in the ultrasonication. Then the resulting product was vacuum filtered, washed, dried and ground to produce a nickel-plated micronized silicon carbide powder.

Figure 3A:
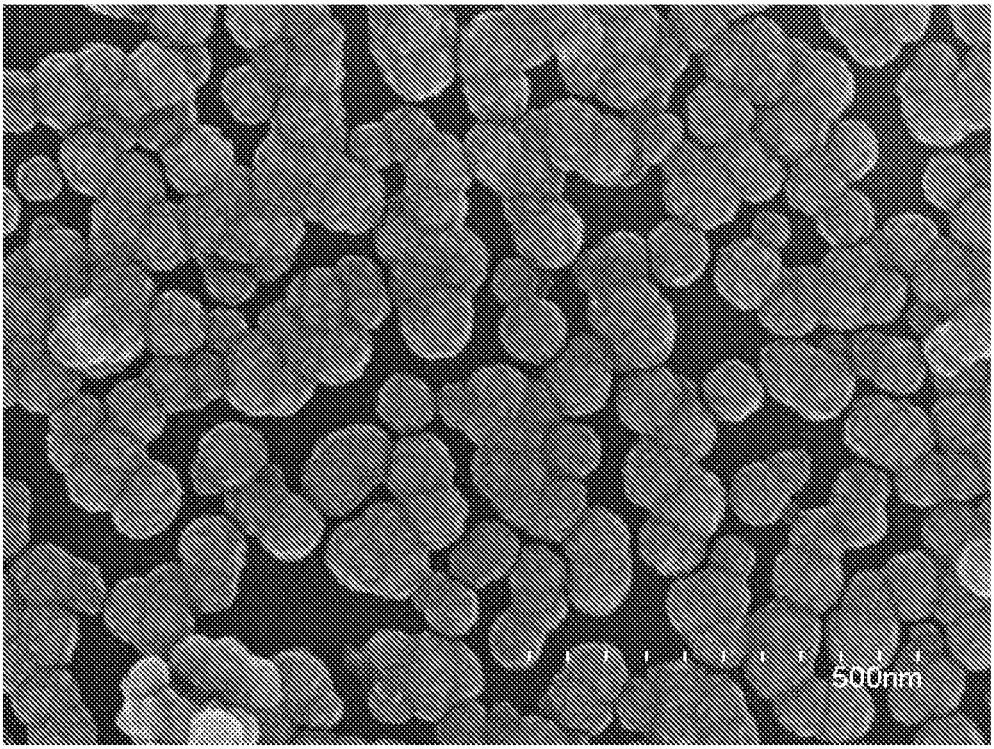
FIGS. 3A-3C show scanning electron microscope (SEM) images with different magnifications of the micronized silicon carbide powder after plating according to a second embodiment.
Figure 3B:
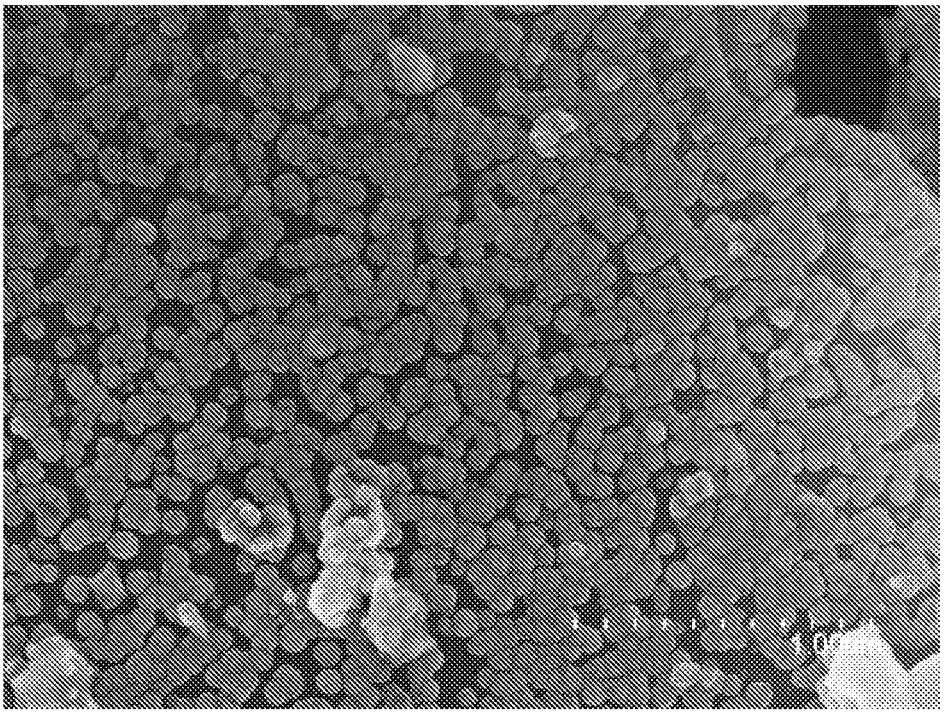
Figure 3C:
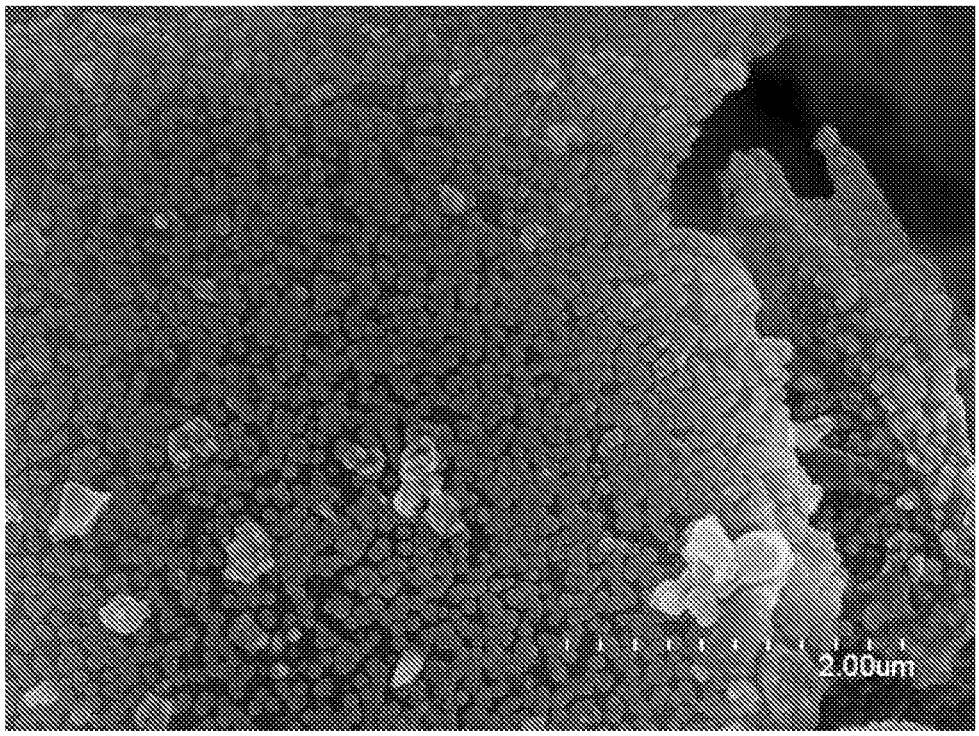

The obtained micronized silicon carbide powder with surface nickel-plated was examined by SEM (scanning electron microscope), and the results revealed that the powder had an excellent dispersibility. The surface of the coating is shown in FIGS. 3A-3C.

SEM and EDS analysis were applied to analyze the surface morphology and composition of the powder before and after plating. The results indicated that nickel could be deposited on the surface of the silicon carbide powder successfully and the surface coating contained Ni and Si. Ultrasonic assist was introduced in the pre-treatment and the plating process of the preparation method to disperse and deagglomerate powder particles in the liquid with the mechanical action and cavitation, thereby achieving a uniform dispersion of the powder in the dispersant. And a reducing agent was slowly added during the plating in order to achieve a more uniform and stable deposition of the coating onto the surface of the powder particles and a silicon carbide core-nickel shell structure material with an excellent powder dispersion and a uniform and stable coating. Furthermore, the method of the invention was simple in operation and controllable in performance.

Comparative Example 1

Materials:

main salt: 18 g/L of nickel sulfate hexahydrate;

reducing agent: 30 g/L of sodium hypophosphite monohydrate;

complexing agent: 15 g/L of trisodium citrate dihydrate, 12 g/L of lactic acid and 3 g/L of succinic acid;

stabilizing agent: 1 mg/L of thiourea, 10 mg/L of potassium iodate and 5 mg/L maleic acid; and brightening agent: 20 mg/L of sorghum sulfate and 30 mg/L of butyne diol.

Preparation of a plating solution was described as follows. Pure water was added into a flask at a volume of 50% of the pre-prepared plating solution and the complexing agent, main salt, stabilizing agent, brightening agent and surfactant were added in sequence under stirring and stirred to dissolve completely. Then the reducing agent was added and stirred to dissolve followed by an addition of pure water to the specific liquid level to produce a mixture. pH of the mixture was adjusted to 4.7 with aqueous ammonia solution (50 wt %), and then heated to 81° C. to obtain a plating solution.

15 g of the activated micronized silicon carbide powder was added into the plating solution under stirring and 10 mL of the reducing agent was added to perform the plating at 60° C. for 2 hours to obtain a micronized silicon carbide powder with surface nickel-plated.

Figure 4A:
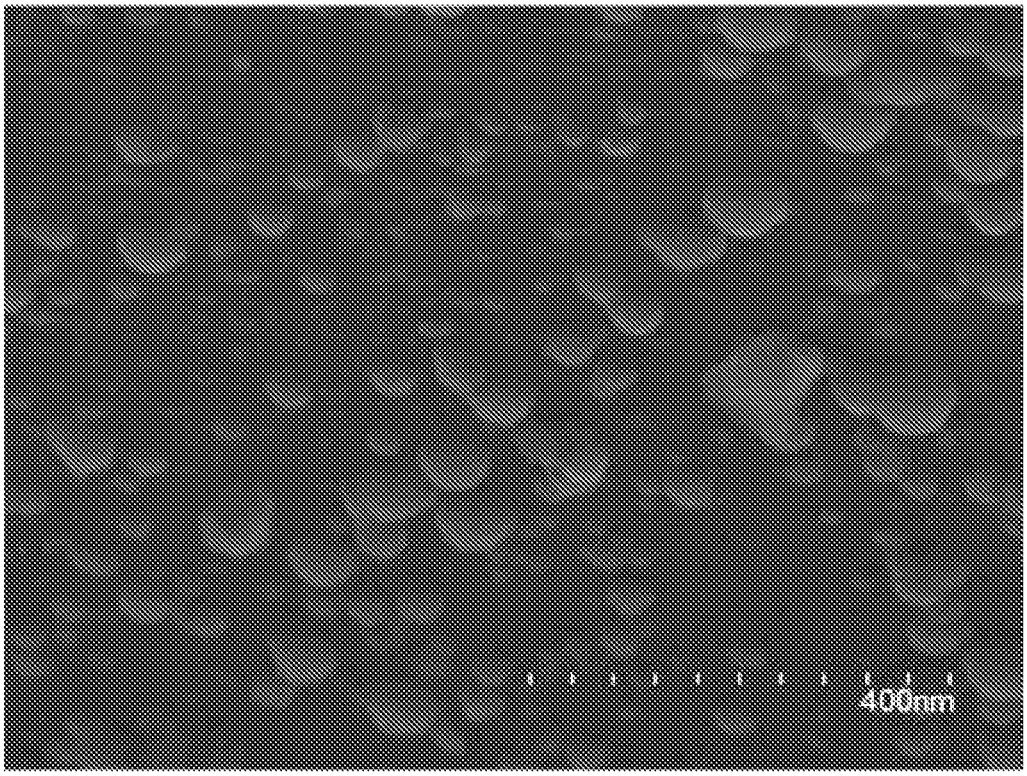
FIGS. 4A-4C show scanning electron microscope (SEM) images with different magnifications of the micronized silicon carbide powder after plating according to a third embodiment.
Figure 4B:
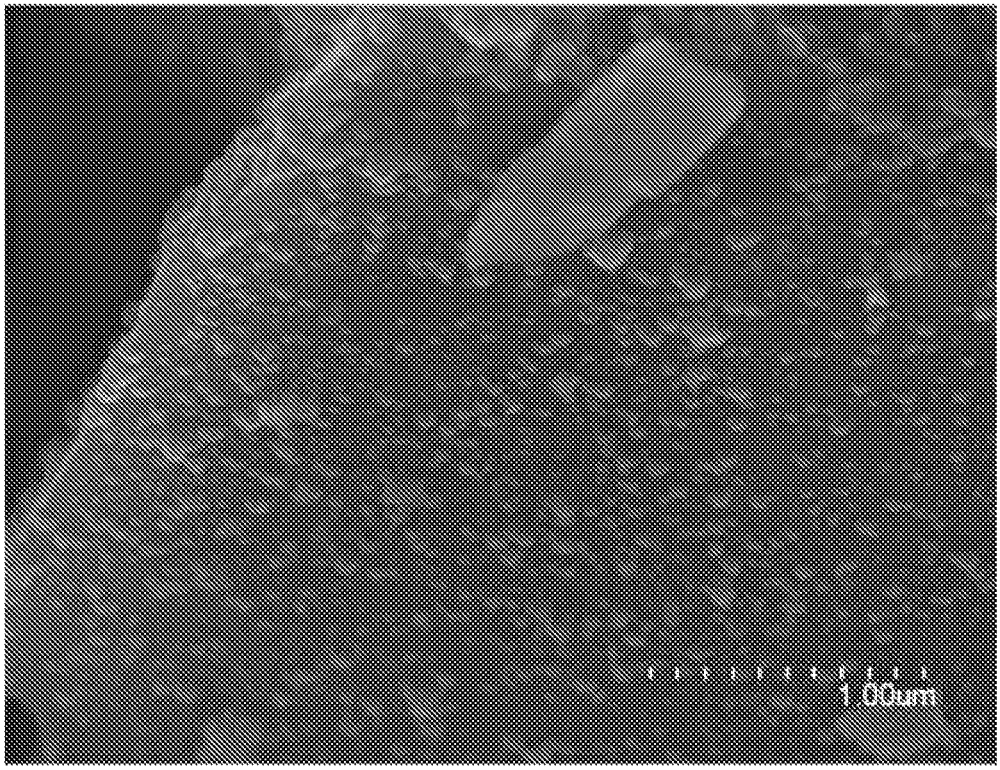
Figure 4C:
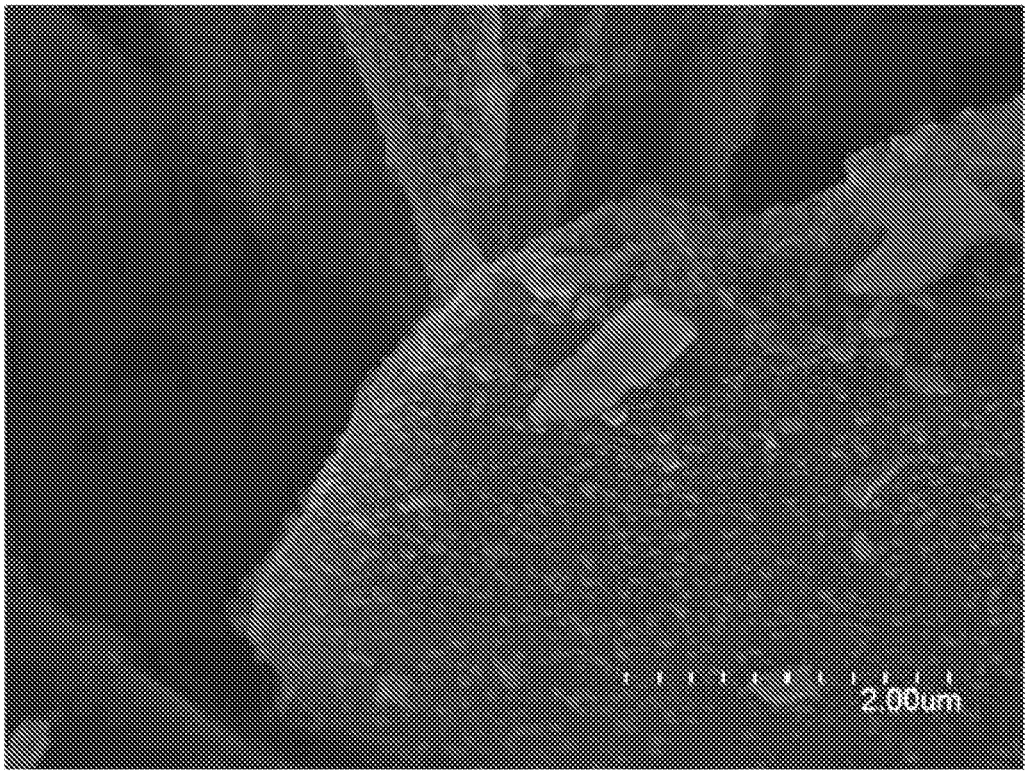
Figure 5:
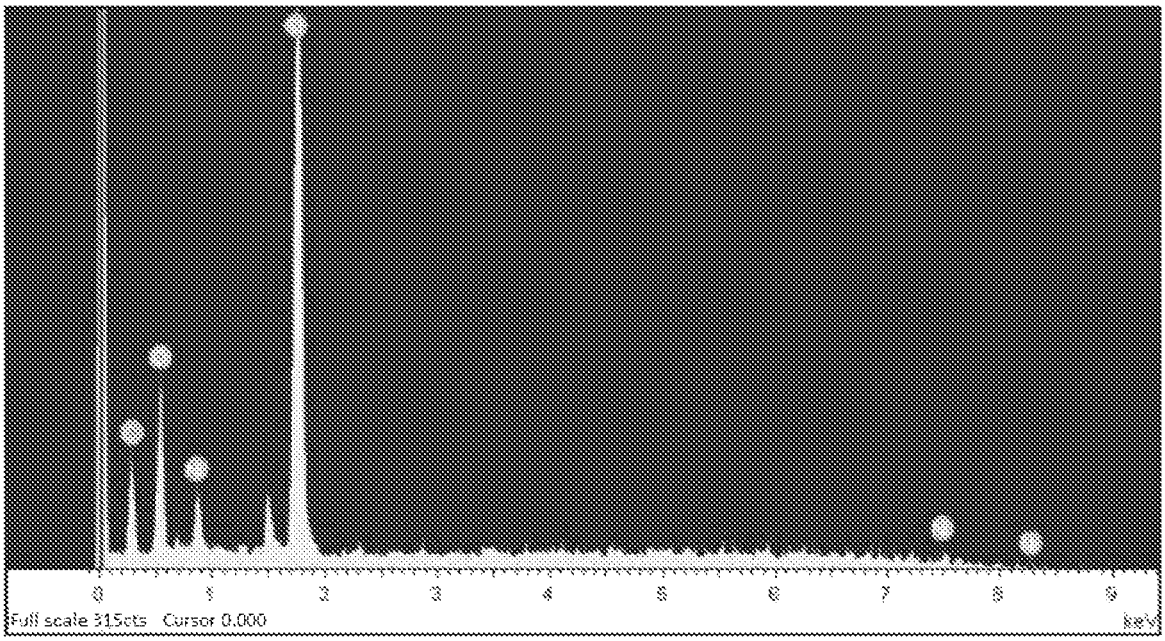
FIG. 5 shows an electron spectroscopy (EDS) image of the micronized silicon carbide powder before and after plating.

The micronized silicon carbide powder with surface nickel-plated was examined with SEM (scanning electron microscope), and the results revealed that the powder had an excellent dispersibility. The coating surface is shown in FIGS. 4A-4C.

It can be concluded that the coating is deposited more uniformly and stably on the surface of the micronized silicon carbide powder in Examples 1 and 2 when compared with the coating in comparative example 1 with the SEM examination.

The embodiments in the present description are described in a progressive manner. Each embodiment focuses on differences from other embodiments, and the same or the similar part between the various embodiments may be referred to each other. Since the device disclosed in the embodiment corresponds to the method disclosed in the embodiment, the description is relatively simple, and the relevant part can be referred to the corresponding part of the method.

The above description of the disclosed embodiments enables those skilled in the art to achieve or utilize the invention. Various modifications to these embodiments are obvious to those skilled in the art, and the general principles defined herein may be implemented in other embodiments without departing from the spirit or scope of the invention. Therefore, the present invention is not intended to be limited by the embodiments presented herein, but to meet the broadest scope consistent with the principles and novel features disclosed herein.

What is claimed is:

1. A method of electroless nickel plating on surface of silicon carbide powder with a uniform and stable coating, comprising:

(1) burning the silicon carbide powder at high temperature to oxidize the silicon carbide powder;

(2) placing the oxidized silicon carbide powder in a hydrophilizing solution to obtain a first suspension; subjecting the first suspension to stirring, ultrasonication, and vacuum filtration to obtain a first residue; and washing the first residue to neutral to produce a hydrophilized silicon carbide powder; wherein the hydrophilizing solution is prepared by dissolving hydrofluoric acid in a hydrochloric acid solution, and the stirring and ultrasonication are alternately performed;

(3) placing the hydrophilized silicon carbide powder in a sensitizing solution to obtain a second suspension; subjecting the second suspension to stirring, ultrasonication, and vacuum filtration to obtain a second residue; and washing the second residue to neutral to produce a sensitized silicon carbide powder; wherein the sensitizing solution is prepared by dissolving stannous chloride in a hydrochloric acid solution, and the stirring and ultrasonication are alternately performed;

(4) placing the sensitized silicon carbide powder in an activating solution to obtain a third suspension; subjecting the third suspension to stirring, ultrasonication, and vacuum filtration to obtain a third residue; and washing the third residue to neutral to obtain an activated silicon carbide powder; wherein the activating solution is prepared by dissolving palladium chloride in a hydrochloric acid solution, and the stirring and ultrasonication are alternately performed;

(5) mixing nickel sulfate, trisodium citrate and ammonium chloride at a weight ratio of 1:4-5:0.2-0.3 to obtain a mixture; dissolving the mixture with water to obtain a plating solution with pH adjusted to 8.5-9.5 by ammonia water; and preparing a sodium hypophosphite solution as a reducing agent for use;

placing the activated silicon carbide powder in the plating solution to obtain a fourth suspension; transferring the fourth suspension to a water bath under simultaneous ultrasonication and stirring for a dispersion; and dripping the reducing agent into the fourth suspension under continuous mechanical stirring and intermittent ultrasonication to perform a reaction when temperature of the plating solution rises to 45-50° C.; and subjecting the resulting product to vacuum filtration; and washing, drying and grinding the product to obtain a nickel-plated micronized silicon carbide powder.

2. The method of claim 1, wherein in step (1), the silicon carbide powder has a particle size of 600-5000 nm.

3. The method of claim 1, wherein in step (1), a burning temperature is 800-1200° C.; and a burning time is 1.5-2.5 hours.

4. The method of claim 1, wherein in step (2), the hydrophilizing solution is prepared by concentrated hydrochloric acid, hydrofluoric acid and water at a volume ratio of 1:0.9-1.1:9-11.

5. The method of claim 1, wherein in step (3), concentration of the stannous chloride in the sensitizing solution is 20-30 g/L and a weight (g)-volume (mL) ratio of the stannous chloride to the concentrated hydrochloric acid is 1:2-3.

6. The method of claim 1, wherein in step (4), concentration of the palladium chloride in the activating solution is 0.3-0.7 g/L, and a weight (g)-volume (mL) ratio of the palladium chloride to the concentrated hydrochloric acid is 1:40-50.

7. The method of claim 1, wherein in steps (3) and (4), the stirring and ultrasonication are alternately performed 5 times each for 2 minutes.

8. The method of claim 1, wherein in step (4), the stirring rate is 5-10 rps.

9. The method of claim 1, wherein in step (5), the sodium hypophosphite solution has a concentration of 0.5-2.0 mol/L of sodium hypophosphite.

10. The method of claim 1, wherein in step (5), one drop of the reducing agent is added every 2-6 seconds, and the dripping and the intermittent ultrasonication are alternately performed, each for 30 seconds, and the reducing agent is not added during the ultrasonication.

* * * * *